US006494596B1

(12) United States Patent
Burroughs

(10) Patent No.: US 6,494,596 B1
(45) Date of Patent: Dec. 17, 2002

(54) REFLECTOR WITH TEXTURED INNER SURFACE AND PRISMATIC OUTER SURFACE

(75) Inventor: Frederick C. Burroughs, Blacksburg, VA (US)

(73) Assignee: Hubbell Incorporated, Orange, CT (US)

( * ) Notice: Subject to any disclaimer, the term of this patent is extended or adjusted under 35 U.S.C. 154(b) by 8 days.

(21) Appl. No.: 09/593,298

(22) Filed: Jun. 13, 2000

(51) Int. Cl.[7] ..... F21V 7/00; F21S 8/00

(52) U.S. Cl. ..... 362/348; 362/340; 362/430; 362/309

(58) Field of Search ..... 362/348, 297, 362/246, 339, 340, 327, 368, 430, 433, 440, 444, 308, 309, 329, 334–338, 453

(56) References Cited

U.S. PATENT DOCUMENTS

| | | | | | |
|---|---|---|---|---|---|
| 821,307 | A | * | 5/1906 | Mygatt | 362/340 |
| 1,413,315 | A | | 4/1922 | Correll | |
| 1,543,606 | A | | 6/1925 | Harrison | |
| 1,891,846 | A | | 12/1932 | Stauber, Jr. | |
| 2,132,784 | A | | 10/1938 | Guth | |
| 3,466,437 | A | | 9/1969 | Ruehl | |
| 3,800,138 | A | | 3/1974 | Shadwick | |
| 3,825,742 | A | | 7/1974 | Levin | |
| 4,285,034 | A | | 8/1981 | Sullivan | |
| 4,611,266 | A | * | 9/1986 | Schwartz | 362/340 |
| 4,839,781 | A | * | 6/1989 | Barnes | 362/309 |
| 4,987,524 | A | | 1/1991 | Miller | |
| 5,121,309 | A | * | 6/1992 | Ewing et al. | 362/368 |
| 5,444,606 | A | * | 8/1995 | Barnes et al. | 362/340 |
| 5,957,565 | A | | 9/1999 | Hofmann | |

* cited by examiner

*Primary Examiner*—Sandra O'Shea
*Assistant Examiner*—Bao Truong
(74) *Attorney, Agent, or Firm*—Tara L. Hoffman; Alfred N. Goodman

(57) ABSTRACT

A reflector for a lighting fixture comprising a substantially bell shaped reflector wall with top and bottom openings and a substantially parabolic cross-section. The reflector wall includes an inner surface having a first top portion that is textured for diffusing light rays from the light source of the fixture, and a second bottom portion that has a smooth surface allowing the light rays to pass through the reflector. The reflector wall also has an outer surface with a plurality of curvilinear prisms for reflecting the light rays. The inner and outer surfaces of the reflector create an even distribution of light emanating therefrom.

18 Claims, 5 Drawing Sheets

REFLECTOR WITH TEXTURED INNER SURFACE AND PRISMATIC OUTER SURFACE

FIELD OF THE INVENTION

The present invention generally relates to a reflector for a lighting fixture. Specifically, the reflector has a portion of its inner surface that is textured to diffuse the light rays from the light source of the lighting fixture, and an outer surface with a plurality of prisms that reflect the lights rays, creating an even dispersal of light.

BACKGROUND OF THE INVENTION

A reflector for a lighting fixture, in particular a surface of revolution type reflector, reflects light from the light source of the fixture in an attempt to produce even illumination on a surface perpendicular to its axis of revolution. Surface of revolution style reflectors are easier to make than other reflectors, such as square or rectangular shaped reflectors. In addition, surface of revolution style reflectors can capture and redirect a greater amount of light with a smaller sized reflector.

However, the prior art surface of revolution reflectors tend to reflect light rays parallel to the axis of revolution, usually downward, and those light rays tend to overwhelm any light projected outwardly away from the axis of revolution, thereby causing a hot spot or spike in the intensity distribution of the reflector which prevents even illumination.

Also, the prior art reflectors fail to counteract the portion of the inner surface of the reflector that is closest to the light source, which contributes the most to creation of hot spots. These hot spots result in light puddles, or bright areas of illumination, and a general uneven overall illumination. In addition, as a consequence of hot spots, in the illumination, smaller fixture spring to mounting ratios are calculated and such that prior art downlights must placed closer together to evenly illuminate a certain area.

Prior attempts to avoid the problem of hot spots, such as varying the location of the light source, have resulted in additional hot spots or undesirable voids in the lighting distribution. In addition, shape variances in the prior art reflectors, light source tolerance, and mounting hardware tolerances can lead to inaccurate light source positioning, increasing the potential for hot spots or voids. Thus, the prior art reflectors require that the light source be critically placed in a specific orientation and location to avoid additional hot spots and voids in the light distribution.

Examples of prior art reflectors are disclosed in the following U.S. Pat. No. 1,412,315 to Correll; U.S. Pat. No. 1,543,606 to Harrison; U.S. Pat. No. 1,891,846 to Stauber, Jr.; U.S. Pat. No. 2,132,784 to Guth; U.S. Pat. No. 3,825,742 to Levin; U.S. Pat. No. 4,285,034 to Sullivan; U.S. Pat. No. 4,987,524 to Miller; and U.S. Pat. No. 5,957,565 to Hofmann.

SUMMARY OF THE INVENTION

Accordingly, an object of the present invention is to provide a reflector for a surface of revolution style light fixture, such as a downlight, that provides an even distribution of light.

Another object of the present invention is to provide a reflector for a downlight that avoids hot spots and voids in the distribution of light from the light source simply, efficiently, and inexpensively.

A further object of the present invention is to provide a reflector for a downlight that allows movement and varying of the placement of the light source while avoiding hot spots and voids in the distribution of light.

A yet further object of the present invention is to provide a reflector for a downlight that allows several downlights to be installed further apart even when the ceiling or mounting surface is low.

The foregoing objects are basically attained by a reflector for a lighting fixture having a light source, comprising a reflector wall including, opposing first and second ends, the first end having a first opening disposed therein, and the second end having a second opening disposed therein, the second opening being substantially larger than the first opening, an inner surface, the inner surface including, a first portion located adjacent the first opening and remote from the second opening, and having a textured surface for diffusing light rays from the light source, and a second portion being located adjacent the second opening and remote from the first opening with the second portion being substantially larger than the first portion, and having a smooth surface, and an outer surface having a plurality of curvilinear prisms thereon extending between the first and second ends for reflecting light rays from the light source.

By structuring the reflector in this fashion, light rays from the light source are diffused by the inner surface of the reflector at the particular problem area portion of the inner surface and reflected by the outer prismatic surface, resulting in an even distribution of light.

BRIEF DESCRIPTION OF THE DRAWINGS

Referring to the drawings which form a part of this disclosure.

DETAILED DESCRIPTION OF THE PREFERRED EMBODIMENT

Figure 5:
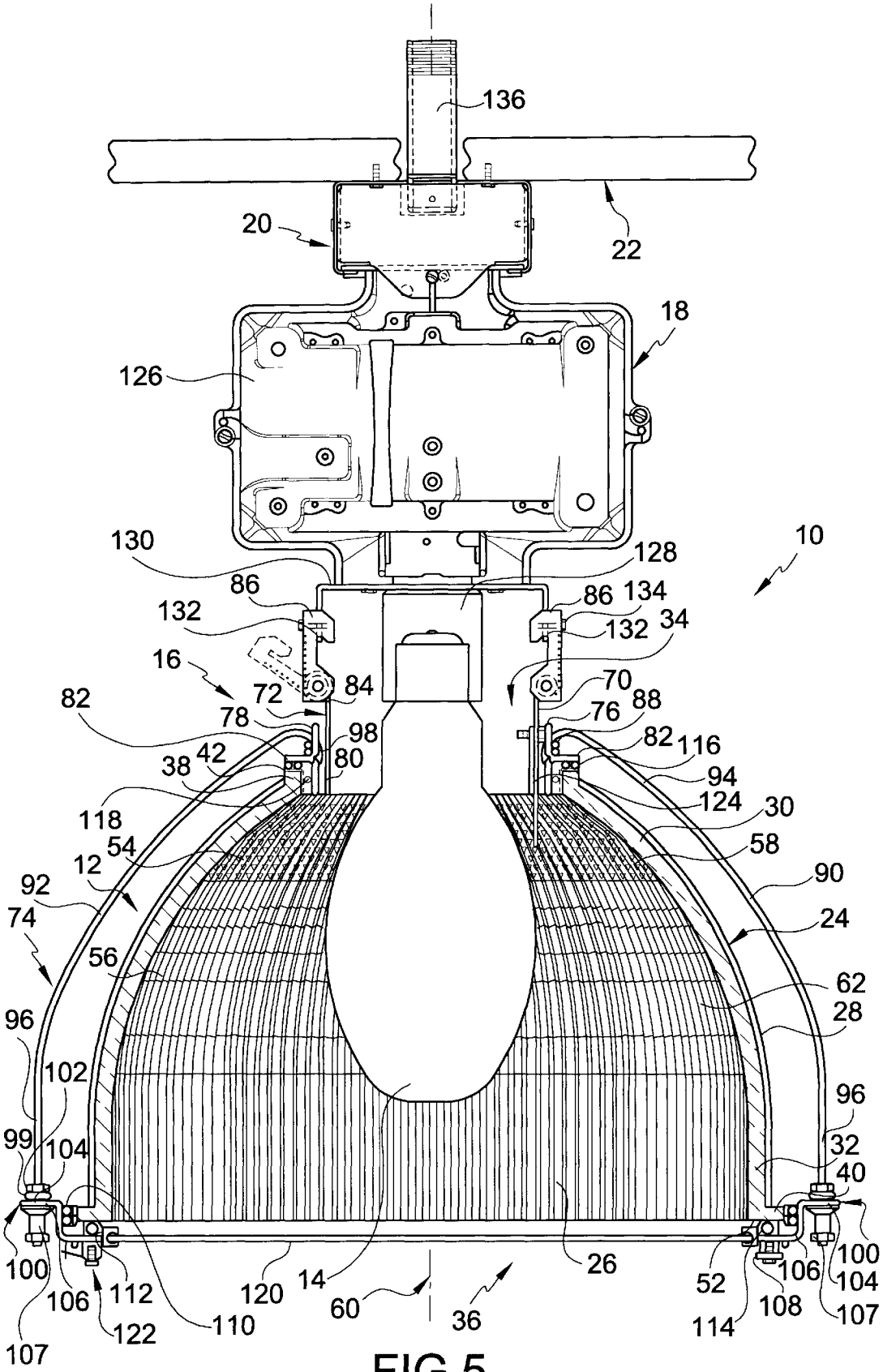
FIG. 5 is a partial cross sectional view of the downlight and reflector according to the present invention, showing the downlight mounted to a ballast unit and a ceiling.

Referring to FIGS. 1–5, a lighting fixture, or downlight, 10 according to the present invention includes a surface of revolution reflector 12, a light source or lamp 14 disposed within the reflector 12, and a mounting assembly 16 for securing downlight 10 to a ballast unit 18 and junction box 20 that are in turn mounted to a mounting surface 22, such as a ceiling, as best seen in FIG. 5.

Reflector 12 is a surface of revolution type of reflector having a central longitudinal axis of revolution 60, and a reflector wall 24 that has a substantially parabolic cross-sectional shape with an inner surface 26 and an outer surface 28. Reflector wall 24 is preferably substantially bell-shaped and formed of a transparent material such as glass, allowing light to pass therethrough. Since reflector 12 is transparent, inner and outer surfaces 26 and 28 are visible from either the inside or the outside of reflector 12, as seen in FIGS. 1–5. Reflector wall 24 further includes a first or top end 30 and an opposing second or bottom end 32. A first or top substantially circular opening 34 is disposed in top end 30 and second or bottom substantially circular opening 36 is disposed in bottom end 32, with the diameter of bottom opening 36 being substantially larger than the diameter of top opening 34.

Reflector wall 24 further includes integral top and bottom annular flanges 38 and 40 that facilitate securement of reflector 12 to mounting assembly 16. Specifically, top flange 38 is disposed at top end 30 and extending upwardly therefrom, and defines the periphery of top opening 34. Similarly, bottom flange 40 is disposed at bottom end 32 and extending outwardly therefrom and defines the periphery of bottom opening 36. Top flange 38 has a planar upper surface 42, a curved annular outer surface 44, and a curved annular inner surface 46 so that outer surface 44 forms a substantially obtuse angle with outer surface 28 of reflector wall 24, as best seen in FIG. 5. Bottom flange 40 has planar upper and lower surfaces 48 and 52 and a curved annular outer surface 50, so that upper surface 48 forms a substantially ninety degree angle with outer surface 28 of reflector wall 24.

Inner surface 26 of reflector wall 24 is concave in shape and comprises first and second portions 54 and 56. First portion 54 is located adjacent top end 30 and remote from bottom end 32, and second portion 56 is located adjacent bottom end 32 and remote from top end 30. Second portion 56 is substantially larger than first portion 54 such that second portion 56 is approximately two-thirds of inner surface 26 and first portion 54 is about one-third.

The majority of or the entire inner surface of first portion 54 is textured to create a substantially frustoconical diffusion surface 58 that re-directs the light rays from lamp 14 in various directions away from the axis of revolution 60 of reflector 12 that would otherwise be directed parallel to the axis of revolution 60 and cause hot spots. Textured surface can be formed in any known manner including but not limited to sand blasting, acid etching, or peening. Second portion 56 of inner surface 26 is substantially or entirely smooth allowing light rays from lamp 14 to pass therethrough to outer surface 28. It is preferable that textured surface 58 be limited to first portion 54 of inner surface 26 and that the remaining second portion 56 be smooth to allow a greater portion of light rays to pass through reflector 12. However, the extent of the textured surface 58 along inner surface 26 can vary depending on the degree of uniformity or smoothness required on the illuminated surfaces receiving light from lamp 14.

Figure 3:
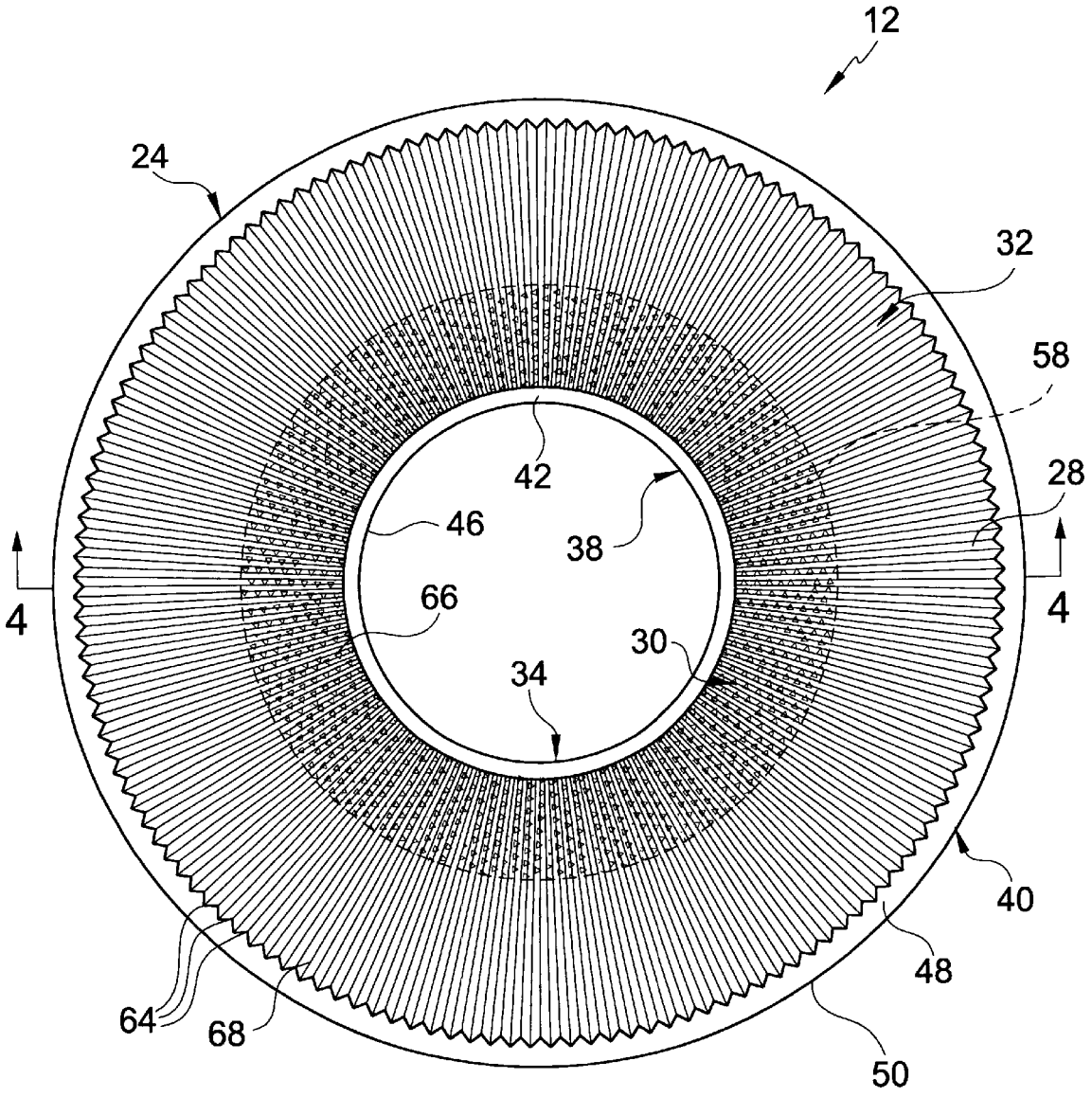
FIG. 3 is a top plan view of the reflector illustrated in FIG. 1, showing a textured inner surface and the outer prismatic surface of the reflector.
Figure 4:
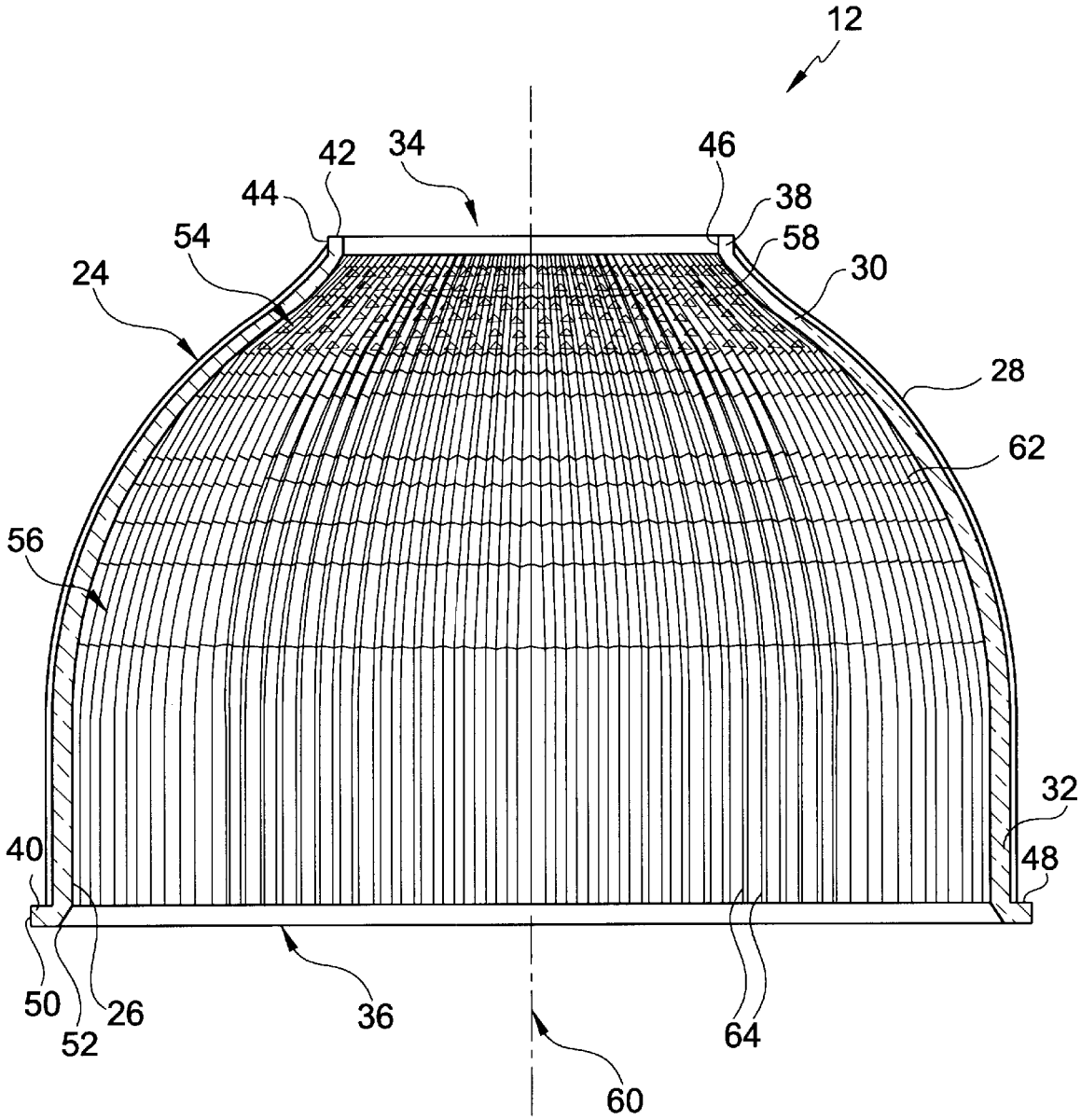
FIG. 4 is a side elevational view in cross-section of the reflector taken along 4—4 of FIG. 3, showing the textured diffusing inner surface of the reflector.

The outer convex surface 28 reflects the light rays that pass through both first and second portions 54 and 56 of inner surface 26. Specifically, outer surface 28 includes a plurality of curvilinear prisms 64 that extend along outer surface 28 between top and bottom flanges 38 and 40 of reflector wall 24. Specifically, each prism 64 has first or top portion 66 that abuts the curved outer surface 44 of top flange 38, and a second or bottom portion 68 that abuts the planar upper surface 48 of bottom flange 40. As best seen in FIG. 3, each prism has a substantially isosceles triangular cross section. The angle at the apex of the triangle is preferably about 90 degrees, varying between 87 to 93 degrees. In addition, each prism 64 tapers in width from its bottom portions 68 to its top portion 66. As the prisms taper the angle of the apex of each prism 64 remains constant as each prism 64 becomes more and more shallow with respect to outer surface 28. Also, the number and width of prisms 64 can varying as desired, as long as outer surface 28 reflects lights rays coming through reflector wall 24.

The majority of the light rays from lamp 14 are reflected by prisms 64 back into reflector 12 and downwardly through bottom opening 36 by the principle of total internal reflection. First portion 54 of inner surface 26 is a particular problem area in causing hot spots in surface of revolution style reflectors because of its proximity to lamp 14. Specifically, more light rays are reflected downwardly by the outer prismatic surface parallel to axis 60, than at a lower portion of the reflector, which spaced further from lamp 14. By texturing the surface of first portion 54 (textured surface 58), the light rays coming from lamp 14 are scattered away from axis of revolution 60 in a substantially conical shape around axis 60 to prevent the light from being directed downwardly and creating a hot spot. In addition, because first portion 54 is textured, varying the location of the lamp 14 with respect to first portion 54 will not create additional hot spots or voids that would disrupt the even illumination. Therefore, precise location of lamp 14 is not required and sensitivity to lamp position and manufacturing tolerances are minimized.

As seen in FIG. 5, mounting assembly 16 includes mounting plates 70 and 72 that mount to the ballast unit 18, and a wire frame form 74 that supports reflector 12. Each of first and second mounting plates 70 and 72 includes first and second support members or struts 76 and 78, respectively, attached thereto proximate the bottom portions 80 of mounting plates 70 and 72, preferably by welding. Each strut includes attached top and bottom L-shaped wire form members and have free end stems 82 extending outwardly, as best seen in FIG. 5. The top portions 84 of first and second mounting plates 70 and 72 each have pivotal C-brackets 86 attached thereto for connection to ballast unit 18. A first or top wire support ring 88 is attached to the outside of struts 76 and 78, preferably by welding, to provide additional reinforcement to mounting assembly 16.

Figure 1:
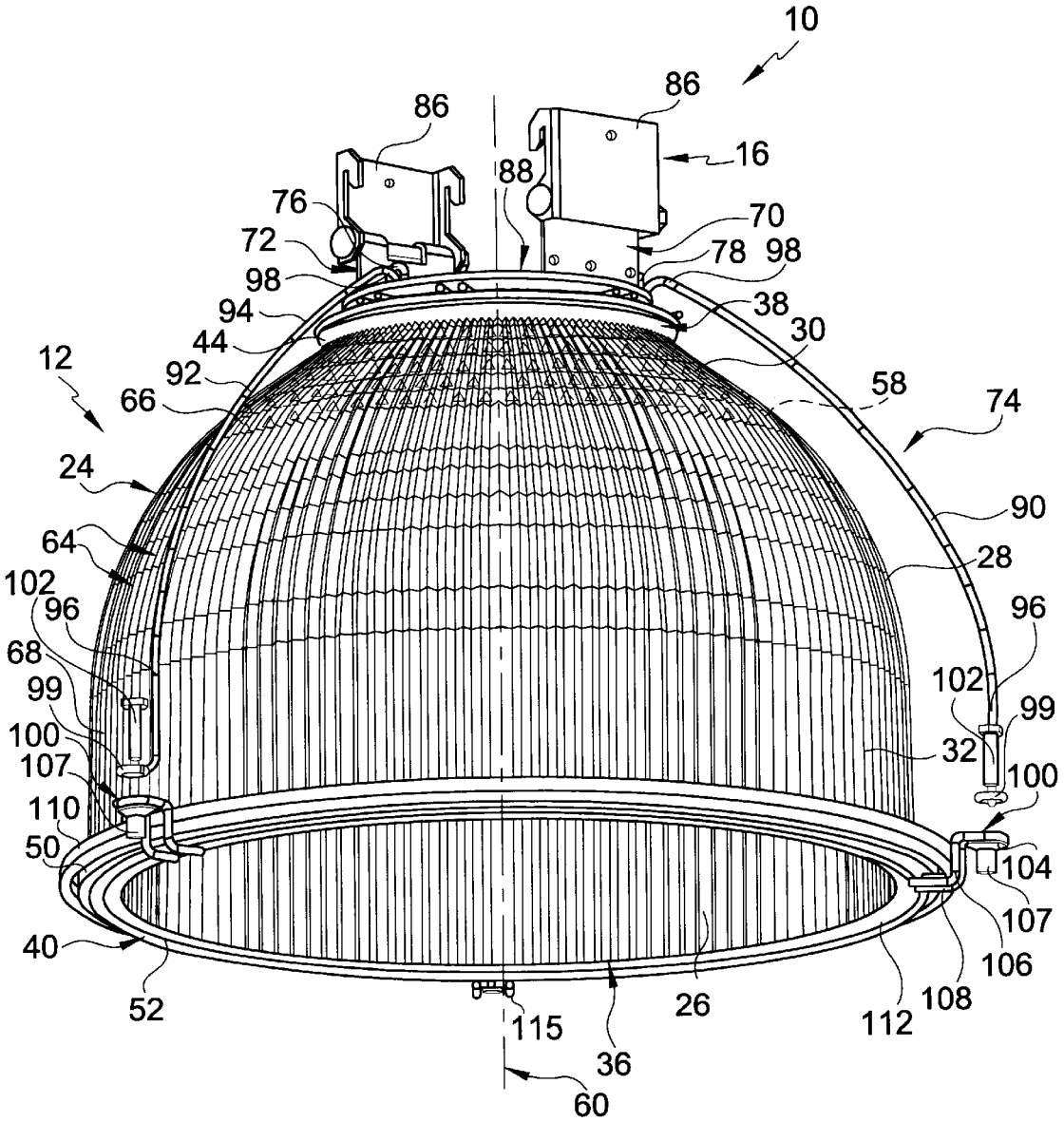
FIG. 1 is a bottom perspective view of a reflector and a mounting and support assembly for a downlight according to an embodiment of the present invention, illustrating the open bottom of the reflector and the assembly partially disassembled.
Figure 2:
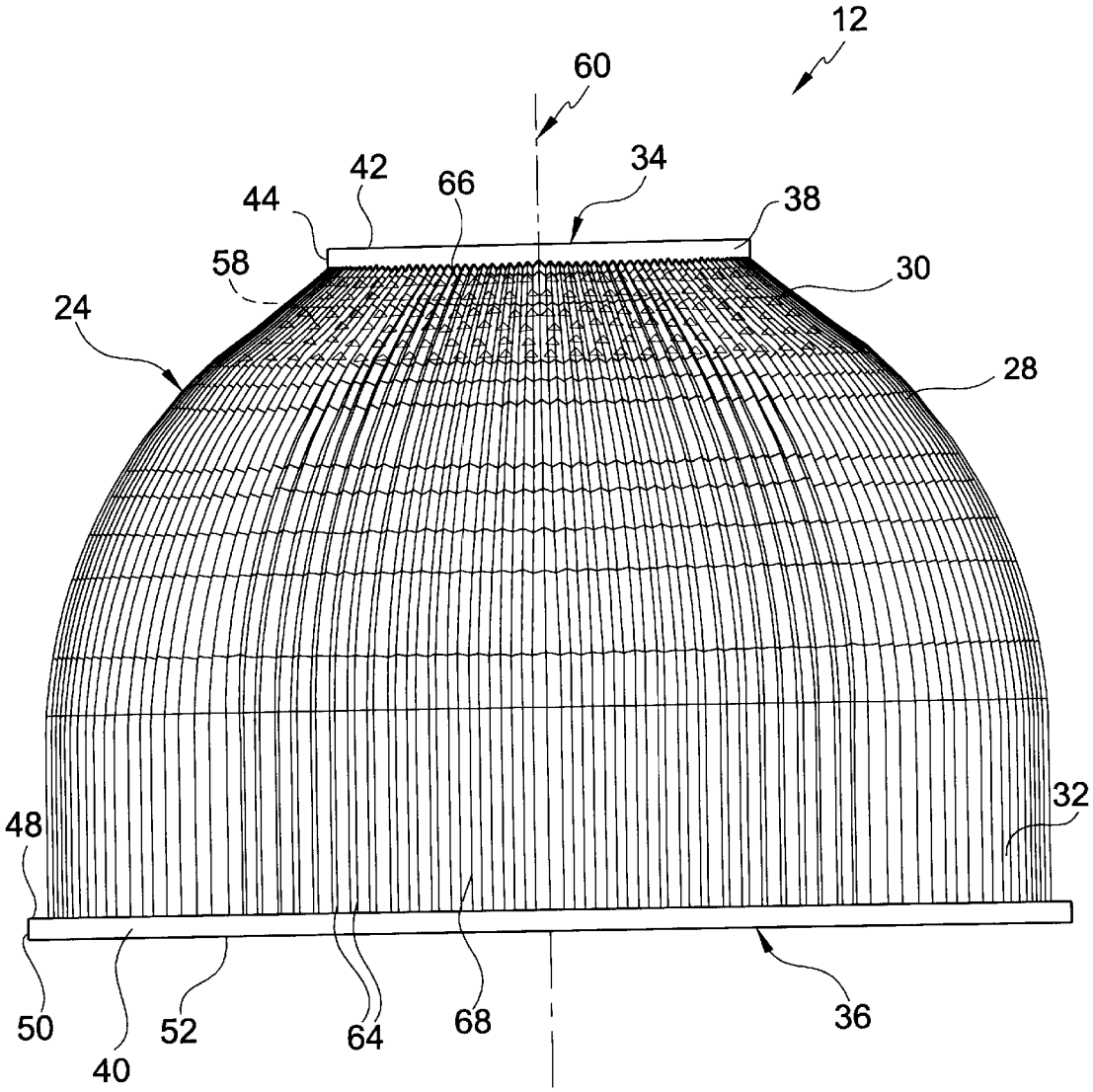
FIG. 2 is a side elevational view of the reflector illustrated in FIG. 1, showing an outer prismatic surface of the reflector.

Wire frame form 74 includes first and second wire frames 90 and 92, each having top and bottom portions 94 and 96. Top portions 94 each have a hook 98 for hooking to loops in struts 76 and 78, respectively, and hooking over and under top wire support ring 88, as best seen in FIG. 1. Bottom portions 96 each include an angled loop 99 for attachment to an extending arm support 100. A fastener 102 is employed for adjusting and tightening each of wire frames 90 and 92 with respect to arms 100. Each arm support 100 comprises a unitary one piece member bent to form a first outwardly extending loop portion 104 with parallel legs forming a second downwardly extending portion 106, and a third inwardly extending portion 108 forming a substantially S-shape, as best seen in FIGS. 1 and 5. An internally threaded nut member 107 is preferably attached to first loop portion 104 of each arm 100 for engaging loop 99 of each wire frame 90 and 92 and receiving fastener 102. A second or bottom wire support ring 110 is attached to arm supports 100 at second portion 106, preferably by welding, to provide rigidity to wire frame form 74. A third wire support ring 112 is attached to the bottom of third portion 108 of arms 100 to also provide support and rigidity to wire frame form 74 and support for reflector 12. Wire frame form 74 can alternatively include a third wire frame similar to wire frames 90 and 92, and that also includes an arm support 115, as seen in FIG. 1.

To assemble downlight 10, reflector 12 is first placed within wire frame form 74. A bottom gasket 114 can be alternatively placed over third wire ring 112 on third portion 108 of arms 100 and bottom flange 40 of reflector 12 would be placed over gasket 114 so that the lower surface 52 of bottom flange 40 abuts gasket 114, as best seen in FIGS. 5. Gasket 114 provides cushioning between reflector 12 and third wire ring 112. Without gasket 114, bottom flange 40 rests directly on third wire ring 112. With reflector 12 resting on arm supports 100, wire frames 90 and 92 are disposed outside of reflector wall 24 for attachment to mounting plates 70 and 72.

Mounting plates 70 and 72 with struts 76 and 78 are placed within top opening 34 of reflector wall 24 until stems 82 of each strut 76 and 78 abut upper surface 42 of top flange 38. A top gasket 116 can be placed between top flange 38 and stems 82 of support struts 76 and 78 for cushioning, as best seen in FIG. 5. A wire ring 118 can alternatively be attached to the bottoms of struts 76 and 78 for proper centering of mounting plates 70 and 72 when placed within top opening 34 of reflector 12.

Wire frames 90 and 92 can then be releasably attached to first and second struts 76 and 78. Specifically, hooks 98 of each wire frame 90 and 92 are hooked onto struts 76 and 78 and top wire ring 88. The resilient and flexible nature of wire frames 90 and 92 allows the wire frames 90 and 92 to stretch slightly so that they can be attached to arm supports 100 of each wire frame, as best seen in FIGS. 1 and 5. In particular, fasteners 102 are inserted through loops 99 of each wire frame 90 and 92 and then tightened with respect to nut 107 securing reflector 12.

Downlight 10 can alternatively include a glass safety lens 120 pivotally attached to one of the arms 100 by a hinge assembly 122, as best seen in FIG. 5. Lens 120 acts to catch any broken glass that may result from an explosion of lamp 14 which could possibly occur, more likely with certain metal halide HID lamps, occurs after long extended use of the downlight without any shutdown in the operation. In addition, downlight 10 can include an auxiliary or backup lamp socket 124.

Once assembled, downlight 10 can be mounted to ballast unit 18. Ballast unit 18 includes a ballast housing 126 that holds the electrical components necessary for operation of downlight 10, an electrically connected socket member 128 for receiving lamp 14, and a mounting frame 130 for supporting downlight 10 via mounting assembly 16. In particular, mounting plates 70 and 72 are coupled to mounting frame 130 of the ballast unit 18 by hooking C-brackets 86 to first and second tabs 132 extending from mounting frame 130. Fasteners 134 are employed to securely attach C-brackets 86 to mounting frame 130.

Once mounted, downlight 10 can be easily detached by removing fasteners 134 and unhooking C-brackets 86. Ballast unit 18 is in turn connected to a junction box 20 which is mounted to mounting surface 22 by any known attachment, such as a rigid conduit 136 or bolts into structural member.

In use, lamp 14, as seen in FIG. 5, is energized and creates illumination that extends radially outward of the lamp and axially downwardly therefrom. The illumination that extends downwardly from the lamp substantially follows the central axis 60 of revolution of the reflector, which substantially coincides with the central longitudinal axis of the lamp, and escapes through the reflector's bottom opening 36.

The illumination, or light, escaping from the lamp and extending radially outwardly therefrom will be intercepted by and incident on the reflector wall, so that the majority of light is reflected back inside the reflector and downwardly, and the remaining light is transmitted outwardly.

In the textured portion at the top of the reflector, some of the light will be scattered inwardly by the textured inner surface, and some of the light will pass through the textured surface and then be reflected downwardly and transmitted upwardly by the prisms on the outer surface adjacent the textured portion. Below the textured portion, some of the light will be reflected by the smooth inner surface, and some of the light will pass through the smooth inner surface and then in turn be reflected back inwardly and downwardly adjacent the smooth portion. A small portion of light will be transmitted outwardly by the prisms adjacent the smooth portion. Therefore, the light emanating from the lamp will be evenly distributed without hot spots and voids.

The relative location of lamp 14 with respect to reflector 12 has several characteristics. Specifically, once connected to-socket member 128, lamp 14 extends downwardly between mounting plates 70 and 72 and into top opening 34 of reflector 12 such that the bottom end of lamp 14 is substantially spaced form bottom opening 36 of reflector 12, as best seen in FIG. 5. Given the parabolic-shaped cross section of reflector 12, first portion 54 of inner surface 26 is closet to lamp 14 both horizontally and axially, and second portion 56 near bottom opening 36 is furthest from lamp 14. Thus, first portion 54 is textured at textured surface 58 due to its close proximity to lamp 14 because the light rays reflected downwardly, as described above, by inner surface 26 at first portion 54 will be closet to and directed along axis of revolution 60 thereby contributing the most to the problem of hot spots. Textured surface 58 scatters the light rays in directions other than parallel to axis 60 thereby avoiding hot spots Moreover, the light rays reflected downwardly by inner surface 26 at second portion 56 will be horizontally spaced from axis of revolution thereby providing proper illumination and not contributing to hot spots generated proximate axis 60. Therefore, smooth surface 62, does not need to be textured. Thus the combination of textured surface 58 and smooth surface 62 of inner surface 26 of reflector 12, creates an overall even illumination.

While a particular embodiment has been chosen to illustrate the invention, it will be understood by those skilled in the art that various changes and modifications can be made therein without departing from the scope of the invention as defined in the appended claims.

What is claimed is:

1. A reflector for a lighting fixture having a light source, comprising:

a reflector wall including, opposing first and second ends, said first end having a first opening disposed therein, and said second end having a second opening disposed therein, said second opening being substantially larger than said first opening, an inner surface, said inner surface including, a first portion being located adjacent said first opening and remote from said second opening, and having a non-prismatic textured diffusing surface for diffusing light rays from the light source, and a second portion being located adjacent said second opening and remote from said first opening with said second portion being substantially larger than said first portion, and having a smooth surface, and an outer surface having a plurality of curvilinear prisms thereon extending between said first and second ends for reflecting light rays from the light source.

2. A reflector according to claim 1, wherein said non-prismatic textured diffusing surface entirely covers said first portion; and said smooth surface entirely covers said second portion.

3. A reflector according to claim 1, wherein said reflector wall is formed of glass.

4. A reflector according to claim 1, wherein said plurality of prisms entirely cover said outer surface of said reflector wall.

5. A reflector according to claim 1, wherein each of said plurality of curvilinear prisms tapers from said second opening to said first opening.

6. A reflector according to claim 1, wherein said first and second ends are top and bottom ends, respectively, and a mounting assembly is disposed on said top end for mounting said reflector to a ballast unit.

7. A reflector according to claim 6, wherein a wire frame is releasably secured to said reflector wall at said top and said bottom end for securing said reflector.

8. A reflector according to claim 7, wherein a lens is releasably secured to said bottom end of said reflector.

9. A reflector according to claim 1, wherein said reflector wall is substantially parabolic in cross-section.

10. A reflector according to claim 1, wherein said non-prismatic textured diffusing surface includes at least one of plurality of sand grains, an acid etching, and a plurality of peens.

11. A lighting fixture assembly, comprising:

a reflector including a reflector wall having opposing first and second ends, said first end having a first opening disposed therein, and said second end having a second opening disposed therein, said second opening being substantially larger than said first opening, an inner surface with a first portion being located adjacent said first opening and remote from said second opening, said first portion having a non-prismatic textured diffusing area, and a second portion being located adjacent said second opening and remote from said first opening with said second portion being substantially larger than said first portion, said second portion being smooth, and an outer surface having a plurality of curvilinear prisms thereon extending between said first and second openings; and a light source disposed within said reflector such that said non-prismatic textured diffusing area of said inner surface diffuses lights rays from said light source in multiple directions, and said outer surface reflects said light rays.

12. A light fixture assembly according to claim 11, wherein said non-prismatic textured diffusing area entirely covers said first portion; said smooth surface entirely covers said second portion; and said plurality of prisms entirely cover said outer surface.

13. A light fixture assembly according to claim 11, wherein said reflector wall has a substantially parabolic shape in cross-section forming an inner area between said first and second openings; and said light source is received within said inner area proximate said first end.

14. A light fixture assembly according to claim 13, wherein a mounting assembly is disposed on said first end of said reflector wall for mounting said reflector and said light source to a ballast unit.

15. A light fixture assembly according to claim 13, wherein a wire frame is releasably secured to said reflector at said first and second ends of said reflector wall securing said reflector to said mounting assembly.

16. A light fixture assembly according to claim 11, wherein said non-prismatic textured diffusing area is defined by at least one of a plurality of sand grains, an acid etching, and a plurality of peens.

17. A light fixture assembly according to claim 11, wherein said reflector is formed of glass.

18. A light fixture assembly according to claim 11, wherein a lens is releasably attached to said second end of said reflector wall.

* * * * *